US011998792B2

(12) United States Patent
Poole

(10) Patent No.: US 11,998,792 B2
(45) Date of Patent: Jun. 4, 2024

(54) PORTABLE FITNESS BENCH

(71) Applicant: Peter Poole, Williamsville, NY (US)

(72) Inventor: Peter Poole, Williamsville, NY (US)

( * ) Notice: Subject to any disclaimer, the term of this patent is extended or adjusted under 35 U.S.C. 154(b) by 0 days.

(21) Appl. No.: 17/689,412

(22) Filed: Mar. 8, 2022

(65) Prior Publication Data

US 2022/0288445 A1 Sep. 15, 2022

Related U.S. Application Data

(60) Provisional application No. 63/159,522, filed on Mar. 11, 2021.

(51) Int. Cl.
*A63B 21/00* (2006.01)
*A63B 71/00* (2006.01)

(52) U.S. Cl.
CPC ..... *A63B 21/4029* (2015.10); *A63B 71/0036* (2013.01); *A63B 2210/00* (2013.01)

(58) Field of Classification Search
CPC ..... A63B 21/4029; A63B 71/0036; A63B 2210/00; A63B 21/0557; A63B 2071/025; A63B 2225/09; A63B 47/00; A63B 21/0726; A63B 2208/023; A63B 2208/0242; A63B 2210/50
See application file for complete search history.

(56) References Cited

U.S. PATENT DOCUMENTS

| | | | | |
|---|---|---|---|---|
| 4,960,277 | A * | 10/1990 | LaRossa | A63B 21/078 482/142 |
| 5,997,442 | A * | 12/1999 | Cordes | A63B 21/072 482/52 |
| 6,454,683 | B1 | 9/2002 | Kaye | |
| 7,614,988 | B1 * | 11/2009 | Kiser | A47C 11/00 482/142 |
| 10,092,791 | B2 | 10/2018 | Donnelly et al. | |
| 10,576,352 | B2 * | 3/2020 | Vester | A63B 21/4029 |
| 2014/0073493 | A1 * | 3/2014 | Parish | A63B 21/0724 482/104 |
| 2014/0113776 | A1 * | 4/2014 | Jaguan | A63B 22/0023 482/57 |
| 2017/0100622 | A1 * | 4/2017 | Wall | A63B 21/4029 |

* cited by examiner

*Primary Examiner* — Andrew S Lo
*Assistant Examiner* — Andrew M Kobylarz
(74) *Attorney, Agent, or Firm* — Boudwin Intellectual Property Law, LLC; Daniel Boudwin

(57) ABSTRACT

A portable fitness bench is provided. The device includes a lower platform. A container is affixed to an upper surface of the lower platform. The container includes a base portion hingedly affixed to a lid portion defining an interior volume. An upper platform is affixed to the lid portion, wherein the upper platform rests along a plane parallel to a plane of the lower platform when the container is in the closed position. A bench support is affixed to an upper side of the upper platform. A first leg is affixed to a lower surface of the lower platform at a first end thereof and a second leg is affixed to the lower surface of the lower platform at a second end thereof. A pair of wheels are affixed to the second end of the lower platform, and a handle is affixed to the first end of the lower platform.

19 Claims, 4 Drawing Sheets

PORTABLE FITNESS BENCH

CROSS REFERENCE TO RELATED APPLICATIONS

This application claims the benefit of U.S. Provisional Application No. 63/159,522 filed on Mar. 11, 2021. The above identified patent application is herein incorporated by reference in its entirety to provide continuity of disclosure.

BACKGROUND OF THE INVENTION

The present invention relates to portable fitness benches. More particularly, the present invention pertains to a portable fitness bench having an integral hinged container for storing additional fitness tools and accessories.

Many individuals enjoy working out in the comfort of their own home. Of these individuals, many prefer to utilize a fitness bench with free weights and resistance cables or bands. However, many of these people live in smaller homes and apartments, and as a result have limited space, which can make usage of a fitness bench and free weights difficult. Particularly, storing fitness benches and additional fitness supplies, such as free weights, resistance cables and bands, bars, and other equipment is particularly challenging with limited space. Furthermore, typical home fitness bench systems are difficult to move from one location to another, which may result in the fitness bench being confined to a single room or force the individual to place the fitness bench in an undesired area, such as a first floor. Typical fitness benches with increased portability or collapsibility often come at the cost of effectiveness and limit the range of exercises possible. In order to address these concerns, the present invention provides users with a collapsible fitness bench capable of a full range of exercises with an integrated storage case for holding items such as elastic bands and cables, free weights, assorted bars, and other personal equipment.

In light of the devices disclosed in the known art, it is submitted that the present invention substantially diverges in design elements from the known art and consequently it is clear that there is a need in the art for an improvement to existing portable fitness benches. In this regard, the instant invention substantially fulfills these needs.

SUMMARY OF THE INVENTION

In view of the foregoing disadvantages inherent in the known types of portable fitness benches now present in the known art, the present invention provides a portable fitness bench wherein the same can be utilized for providing convenience for the user when storing and transporting various additional fitness tools and accessories in an integral container.

The present system comprises a lower platform and a container affixed to an upper surface of the lower platform. The container comprises a base portion hingedly affixed to a lid portion defining an interior volume therebetween. The container is selectively movable between an open position and a closed position, wherein the closed position the lid portion is removably secured to the base portion enclosing the interior volume. An upper platform is affixed to the lid portion, wherein the upper platform rests along a plane parallel to a plane of the lower platform when the container is in the closed position. A bench support is affixed to an upper side of the upper platform. A pair of legs are affixed to a lower surface of the lower platform, wherein a first leg of the pair of legs is affixed to a first end of the lower platform and a second leg of the pair of legs is affixed to a second end of the lower platform. A pair of wheels is affixed to the second end of the lower platform and a handle is affixed to the first end of the lower platform.

In some embodiments, a pair of support struts are affixed to the upper surface of the lower platform on opposing ends of the container such that an upper end of each support strut rests flush against the upper platform when the container is in the closed position. In another embodiment, the handle comprises a telescopic structure selectively movable between an extended position and a retracted position. In other embodiments, the pair of wheels comprise castors rotatably affixed to the second end. In yet another embodiment, the pair of wheels include a lock configured to prevent actuation of the wheels when engaged. In some embodiments, the pair of legs are hingedly affixed to the lower surface, such that the pair of legs are selectively movable between a folded position and an unfolded position, wherein the folded position the pair of legs rest flush against the lower surface of the lower platform. In another embodiment, each leg of the pair of legs further comprise a pair of perpendicular feet extending from a lower end thereof. In other embodiments, the pair of perpendicular feet of the first leg comprise a length greater than a length of the pair of perpendicular feet of the second leg. In yet another embodiment, a connector is disposed on an upper side of each foot of the pair of perpendicular feet. In some embodiments, the connector comprises a D-ring pivotally affixed to a bracket affixed to the upper side of each foot. In another embodiment, at least one latch is affixed to the lid portion, the latch removably securable to the base portion, wherein the latch retains the container in the closed position. In other embodiments, a grip is hingedly affixed to a front side of the lower portion of the container. In yet another embodiment, a height of the lower portion is greater than a height of the lid portion. In some embodiments, the bench support comprises a pivotally affixed back portion and a statically affixed seat portion. In another embodiment, an arm is pivotally affixed to the upper platform, wherein a distal end of the arm engages a rear surface of the back portion to retain the back portion in an elevated position. In other embodiments, the arm is disposed within a channel defined in the upper side of the upper platform, such that the back support rests flush against the upper side when in a lowered position. In yet another embodiment, the back portion comprises a greater width than a width of the seat portion. In some embodiments, the upper surface is recessed defining a perimeter lip about the lower platform. In another embodiment, an upper perimeter edge of each of the back portion and the seat portion are beveled. In other embodiments, the handle comprises a plurality of finger wells therein.

BRIEF DESCRIPTION OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1A:
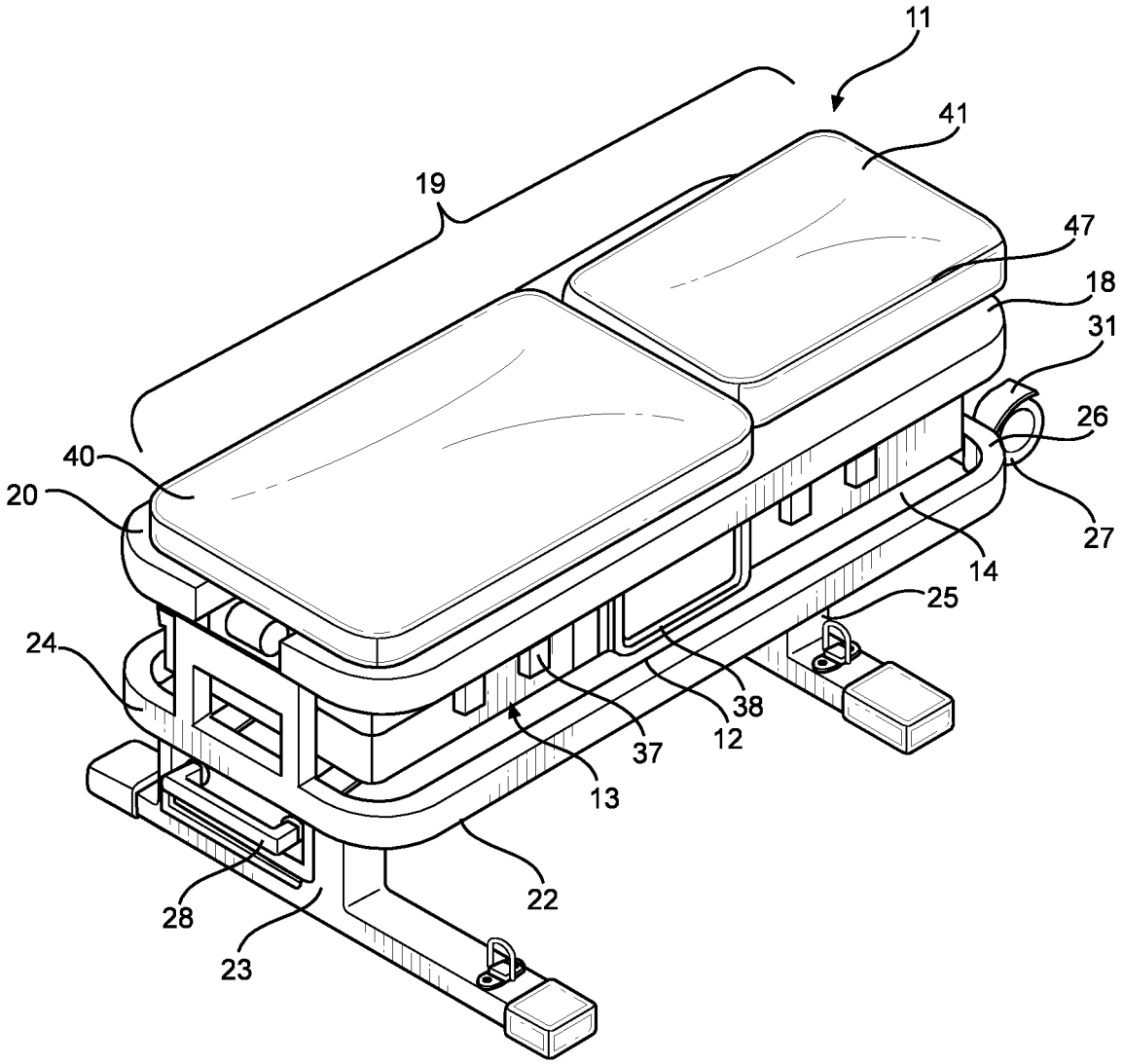
FIG. 1A shows a perspective view of the container of an embodiment of the portable fitness bench in a closed position.

Reference is made herein to the attached drawings. Like reference numerals are used throughout the drawings to depict like or similar elements of the portable fitness bench. The figures are intended for representative purposes only and should not be considered to be limiting in any respect.

Figure 1B:
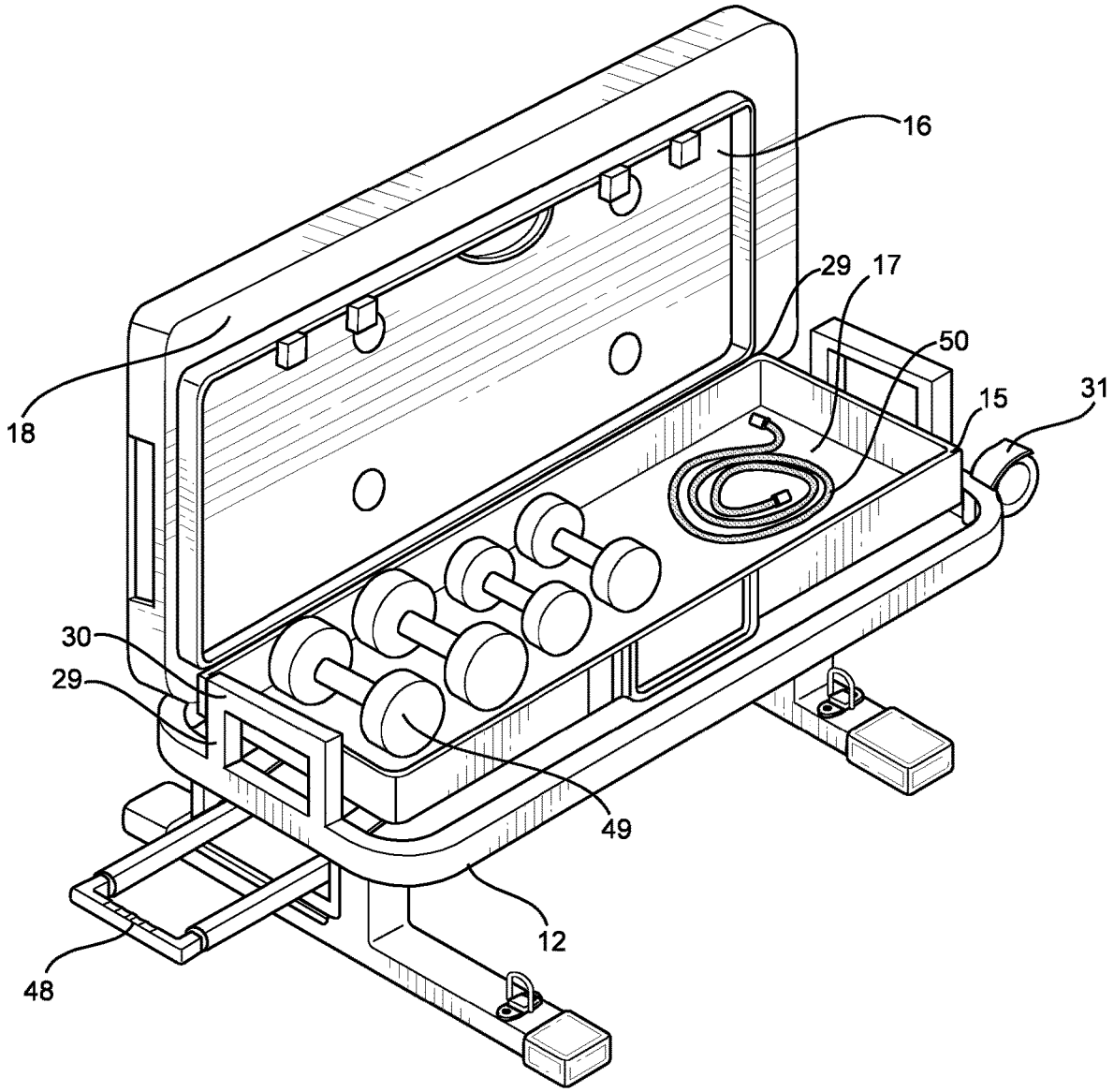
FIG. 1B shows a perspective view of the container of an embodiment of the portable fitness bench in an open position.

Referring now to FIGS. 1A and 1B, there is shown a perspective view of the container of an embodiment of the portable fitness bench in a closed position and a perspective view of the container of an embodiment of the portable fitness bench in an open position, respectively. The portable fitness bench 11 comprises a lower platform 12, an upper platform 18, and a container 13 affixed therebetween. In the shown embodiment, the upper and lower platforms 18, 12 comprise an identical size and shape, and overlie each other such that a perimeter of each of the upper and lower platforms 18, 12 aligned. The container 13 is selectively movable between a closed position (as shown in FIG. 1A) and an open position (as shown in FIG. 1B). When the container 13 is in the closed position, the upper platform 18 is contemplated to rest along a plane parallel to that of the lower platform 12. In this manner, when the container 13 is closed, the user can lie or recline on the upper platform 18 of the portable fitness bench 11 to perform exercises with the assistance of weights 49 or resistance bands 50, as further described elsewhere herein. In the illustrated embodiment, a handle 28 is affixed to a first end 24 of the lower platform 12 along a lower surface 22 thereof, such that the handle 28 is disposed along a plane parallel to that of the lower platform 12. In some embodiments, the handle 28 is telescopically adjustable in length, such that the handle 28 is selectively movable between a retracted position (as shown in FIG. 1A) and an extended position (as shown in FIG. 1B). In some embodiments, the handle 28 is disposed within a handle housing disposed on the lower surface 22 of the lower platform 12, such that the handle 28 is protected on all sides when in the retracted position. In some such embodiments, the handle 28 comprises a head affixed to a pair of perpendicular members, wherein the perpendicular members comprise the telescopic structure for selective adjustment of the length of the handle 28. In such embodiments, the pair of perpendicular members are disposed on opposing lateral sides of a first leg 23. In the shown embodiment, the handle 28 further includes a plurality of finger wells 48 thereon to provide a comfortable gripping surface. Furthermore, a pair of wheels 27 are affixed to a second end 26 of the lower platform 12, such that the portable fitness bench 11 can be easily transported from one location to another. In some such embodiments, the plurality of wheels 27 are rotatably affixed to the second end 26, such that the pair of wheels 27 are configured to rotate about a longitudinal axis of the lower platform 12. A pair of legs extend orthogonally from a lower surface 22 of the lower platform 12, wherein the pair of legs include a first leg 23 adjacent to the first end 24 of the lower platform 12 and a second leg 25 adjacent to the second end 26 of the lower platform 12. In this manner, the portable fitness bench 11 is elevated from a ground surface to facilitate comfortable exercise positions.

The container 13 comprises a lid portion 16 hingedly affixed to a base portion 15, defining an interior volume 17 therebetween. The lid portion 16 is affixed to the lower surface of the upper platform 18 and the base portion 15 is affixed to the upper surface 14 of the lower platform 12, such that as the upper platform 18 moves with the lid portion 16 as the container 13 is moved to the open position. In the illustrated embodiment, the base portion 15 comprises a greater depth than the lid portion 16, such that the weights 49, resistance bands 50, or other exercise equipment can be easily placed within the base portion 15 for storage. Additionally, as the lid portion 16 comprises a smaller portion of the container 13, the weight of the lid portion 16 and associated upper platform 14 is minimized to facilitate movement of the container 13 between the open and closed positions with minimal effort. In the illustrated embodiment, a pair of support struts 29 are affixed to the upper surface 14 of the lower platform 12 on opposing ends of the container 13, wherein the upper platform 18 is contemplated to rest flush against an upper end 30 of each of the pair of support struts 29 when the container is in the closed position. In this manner, the weight of the upper platform 18 and a user exercising thereon is transferred through the pair of support struts 29 to the lower platform 12 and the pair of legs, thereby reducing stresses placed upon the container 13 during use. In the shown embodiment, the container 13 further comprises one or more latches 37 affixed to the lid portion 16, wherein the latches 37 removably secure the lid portion 16 to the base portion 15 when the container is in the closed position. In this manner, the portable fitness bench 11 can be retained in the closed position, preventing the container 13 from opening during transport when the portable fitness bench 11 is raised to roll on the pair of wheels 27. Furthermore, in the shown embodiment, a grip 38 is pivotally affixed to a front side of the base portion 15 of the container 13 to provide the user a gripping surface for manipulating the container 13 between the open and closed positions.

A bench support 19 is affixed to an upper side 20 of the upper platform 18, wherein the bench support 19 provides a comfortable resting platform for a user to exercise on. In some embodiments, the bench support 19 comprises a padded cushion to further increase user comfort during exercise. In the illustrated embodiment, the bench support 19 further comprises a seat portion 41 adjacent to a back portion 40, wherein the seat and back portions 41, 40 are dimensioned to provide support to a user's lower and upper body, respectively. In such embodiments, the back portion 40 comprises a width and length greater than that of the seat portion 41 to accommodate the user's torso thereon. In some embodiments, an upper perimeter edge 47 of each of the back and seat portions 40, 41 comprise a beveled structure to facilitate freedom of movement thereon, as the beveled edge allows a user to extend their arms or legs below the plane of the upper platform 18. In the shown embodiment, the upper perimeter edge 47 of each of the back and seat portions 40, 41 is rounded to reduce sharp edges to further increase user comfort.

Figure 2:
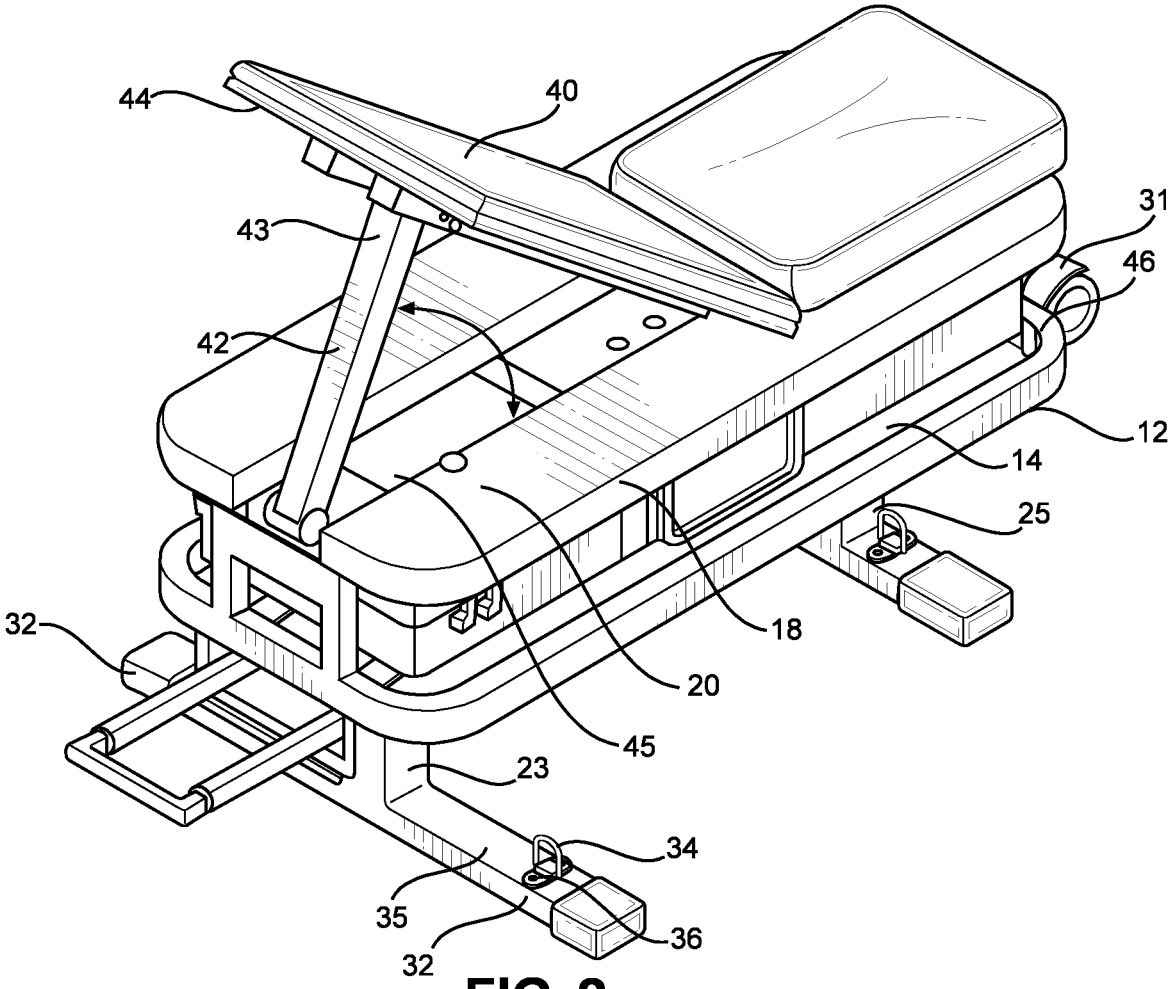
FIG. 2 shows a perspective view of the back support of an embodiment of the portable fitness bench in an elevated position.

Referring now to FIG. 2, there is shown a perspective view of the back support of an embodiment of the portable fitness bench in an elevated position. In the illustrated embodiment, the back portion 40 of the bench support is selectively movable between a raised position (as shown in FIG. 2) and a lowered position (as shown in FIG. 1A). Furthermore, in the shown embodiment, an arm 42 is pivotally affixed to the upper side 20 of the upper platform 18 adjacent to the first side thereof, wherein a distal end 43 of the arm 42 operably engages a rear surface 44 of the back support 40 to retain the back support 40 in the raised position. In such embodiments, the distal end 43 of the arm 42 can operably engage the rear surface 44 at several discrete points along a length of the back portion 40, such that the user can selectively adjust an angle of the back portion 40 relative to the upper platform 18. In the illustrated embodiment, a channel 45 is disposed within the upper side 20 of the upper platform 18, wherein the arm 42 is positioned within the channel 45. In this manner, when the arm 42 pivots to lower the back support 40, the arm 42 rests within the channel 45 allowing the back support 40 to rest flush against the upper side 20 of the upper platform 18 when in the lowered position. In some such embodiments, a pair of bars are disposed along a longitudinal axis of the back support 40, wherein the arm 42 operably secures between the pair of bars to retain the back support 40 in the raised position. In such embodiments, a linear distance between the pair of bars is less than a width of the channel 45, such that the pair of bars rest within the channel 45 when the back support 40 is in the lowered position. In some embodiments, a plurality of cross braces extend between the pair of bars, wherein the distal end 43 of the arm 42 engages one of the plurality of cross braces to retain the back support 40 in the raised position. Alternatively, in some embodiments, a plurality of recesses are disposed within the rear surface 44 of the back support 40, wherein the distal end 43 of the arm 42 rests engages one of the plurality of recesses to maintain the back support 40 in the raised position.

In the illustrated embodiment, each of the first and second legs 23, 25 further comprise a pair of perpendicular feet 32 extending from a lower end thereof. In the shown embodiment, a connector 34 is affixed to an upper side 35 of each of the perpendicular feet 32, wherein the connector 34 is configured to removably secure an exercise device, such as a resistance band, thereto. In some embodiments, the connector 34 comprises a D-ring pivotally affixed to a bracket 36 affixed to the upper side 35, such that the connector 34 pivots to accept an exercise device from a variety of positions to support various exercises performed on the portable fitness bench. In the shown embodiment, the pair of perpendicular feet 32 extending from the first leg 23 have a greater length of the pair of perpendicular feet 32 extending from the second leg 25, such that the connectors 34 are disposed further from the central axis of the upper and lower platforms 18, 12 to facilitate usage with resistance bands or other exercise devices. Furthermore, in the shown embodiment, a foot member is affixed about a distal end of each of the perpendicular feet 32, wherein the foot member is configured to frictionally engage a ground surface to prevent shifting of the portable fitness bench during use.

In the illustrated embodiment, the upper surface 14 of the lower platform 12 is recessed defining a perimeter lip 46 about the lower platform 12. In this manner, the container is disposed within the recessed upper surface 14, thereby decreasing the distance between the upper platform 18 and the lower platform 12 as the container is disposed partially within at least the lower platform 12. In alternate embodiments, a similar recess is disposed within a lower side of the upper platform 18 to further encapsulate the container and reduce the distance between the upper and lower platforms 18, 12 to minimize the overall form factor of the portable fitness bench for efficient transport and storage. Furthermore, the perimeter lip 46 provides a barrier about the container adding another layer of protection about the container. In the shown embodiment, the pair of support struts further comprise an opening therethrough, wherein the opening is disposed through a center of each of the pair of support struts, thereby reducing material costs of manufacture and overall weight of the portable fitness bench.

Figure 3:
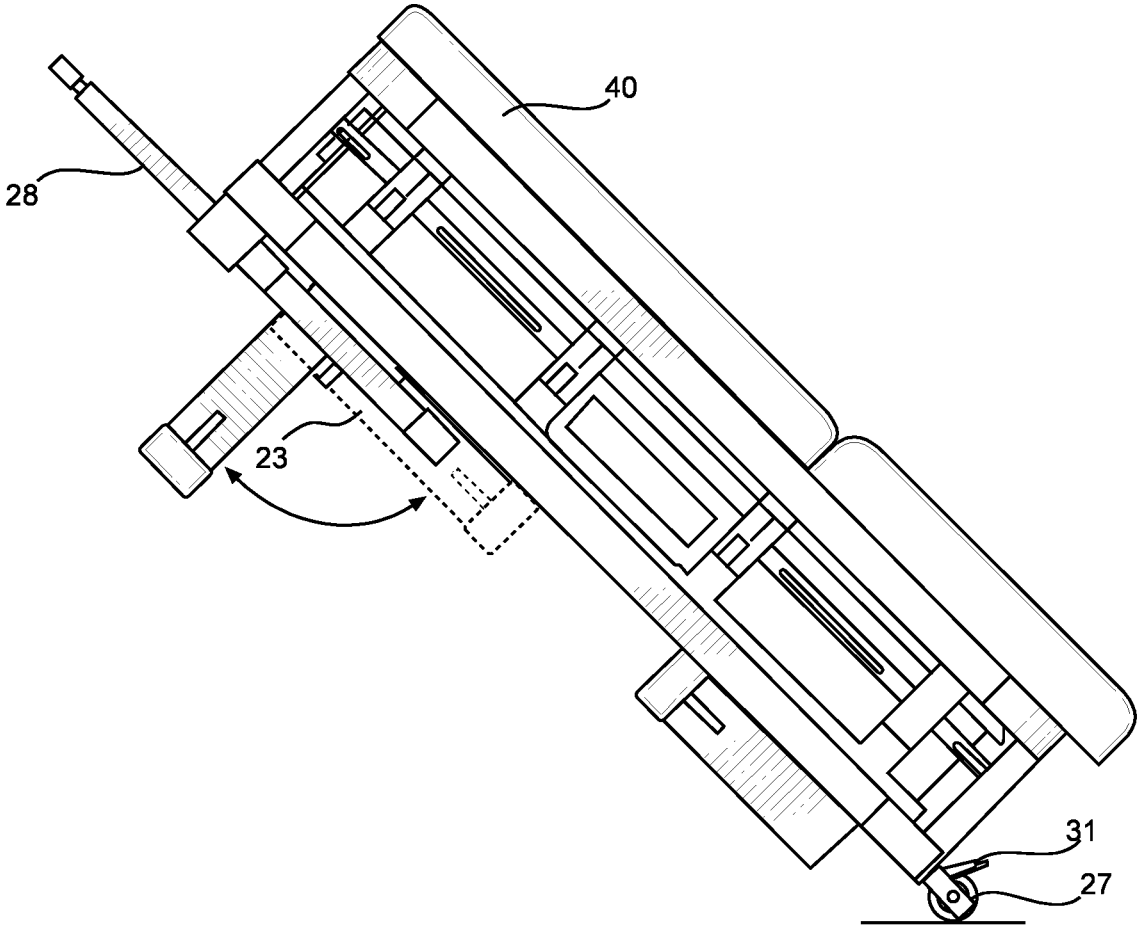
FIG. 3 shows a perspective view of the portable fitness bench in a collapsed position for transport.

Referring now to FIG. 3, there is shown a perspective view of the portable fitness bench in a collapsed position for transport. In the illustrated embodiment, the first leg 23 and the second leg are hingedly affixed to the lower platform 12, such that each leg is collapsible to rest flush against the lower surface 22 of the lower platform 12 when the user wishes to transport or store the portable fitness bench. As such, each leg is selectively movable between a deployed position orthogonal to the lower platform 12 and a collapsed position parallel to the lower platform 12. Each leg is further contemplated to be locked in each position, such that the legs are retained in the desired position during use and transport, respectively. When the user desires to transport or store the portable fitness bench, the back support 40 can be secured in the lowered position and each leg can be folded to the collapsed position and the portable fitness bench can be upended to engage the pair of wheels 27 with the ground surface. Once upended, the user can extend and grasp the handle 28 to transport the portable fitness bench to a desired location. In the shown embodiment, the pair of wheels 27 further comprise a locking mechanism 31 configured to prevent rotation of the pair of wheels 27. In this manner, the user can store the portable fitness bench in a stable, upright position supported by the locked pair of wheels 27. In some embodiments, the handle 28 comprises a cushioned material to provide increased comfort to the user. In this manner, the portable fitness bench can store various exercise equipment to facilitate a complete exercise regimen while also providing ease of transport and storage between uses.

It is therefore submitted that the instant invention has been shown and described in various embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly, and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A portable fitness bench, comprising:

a lower platform;

a container affixed to an upper surface of the lower platform;

wherein the container comprises a base portion hingedly affixed to a lid portion defining an interior volume therebetween;

wherein the container is selectively movable between an open position and a closed position;

wherein the container is in the closed position and the lid portion is removably secured to the base portion enclosing the interior volume of the container;

an upper platform affixed to the lid portion;

wherein the upper platform rests along a plane parallel to a plane of the lower platform when the container is in the closed position;

a bench support affixed to an upper side of the upper platform;

a pair of legs affixed to a lower surface of the lower platform;

wherein a first leg of the pair of legs is affixed to a first end of the lower platform and a second leg of the pair of legs is affixed to a second end of the lower platform;

a pair of wheels affixed to the second end of the lower platform;

a handle affixed to the first end of the lower platform; and a pair of support struts each affixed to the upper surface of the lower platform on opposing ends of the container, such that an upper end of each of the support struts rests flush against the upper platform when the container is in the closed position.

2. The portable fitness bench of claim 1, wherein the handle comprises a telescopic structure that is selectively movable between an extended position and a retracted position.

3. The portable fitness bench of claim 1, wherein the pair of wheels comprise a pair of castors rotatably affixed to the second end of the lower platform.

4. The portable fitness bench of claim 1, wherein the pair of wheels each include a lock configured to prevent actuation of the pair of wheels when engaged.

5. The portable fitness bench of claim 1, wherein the pair of legs are hingedly affixed to the lower surface of the lower platform, such that the pair of legs are selectively movable between a folded position and an unfolded position, wherein the folded position of the pair of legs rests flush against the lower surface of the lower platform.

6. The portable fitness bench of claim 1, wherein the first leg and the second leg of the pair of legs further comprise a pair of perpendicular feet extending from a lower end thereof.

7. The portable fitness bench of claim 6, wherein the pair of perpendicular feet of the first leg comprise a length greater than the pair of perpendicular feet of the second leg.

8. The portable fitness bench of claim 6, further comprising a connector disposed on an upper side of each of the feet of the pair of perpendicular feet.

9. The portable fitness bench of claim 8, wherein the connector comprises a D-ring pivotally affixed to a bracket affixed to the upper side of each of the feet of the pair of perpendicular feet.

10. The portable fitness bench of claim 1, further comprising at least one latch affixed to the lid portion, the at least one latch removably securable to the base portion, wherein the at least one latch retains the container in the closed position.

11. The portable fitness bench of claim 1, further comprising a grip hingedly affixed to a front side of a lower portion of the container.

12. The portable fitness bench of claim 11, wherein a depth of the lower portion of the container is greater than a depth of the lid portion.

13. The portable fitness bench of claim 1, wherein the bench support comprises a pivotally affixed back portion and a statically affixed seat portion.

14. The portable fitness bench of claim 13, further comprising an arm pivotally affixed to the upper platform, wherein a distal end of the arm engages a rear surface of the pivotally affixed back portion to retain the pivotally affixed back portion in an elevated position.

15. The portable fitness bench of claim 14, wherein the arm is disposed within a channel defined in the upper side of the upper platform, such that a back support rests flush against the upper side of the upper platform when in a lowered position.

16. The portable fitness bench of claim 13, wherein the pivotally affixed back portion comprises a greater width than a width of the seat portion.

17. The portable fitness bench of claim 1, wherein the upper surface of the lower platform is recessed defining a perimeter lip about the lower platform.

18. The portable fitness bench of claim 1, wherein an upper perimeter edge of each of the pivotally affixed back portion and the seat portion are rounded.

19. The portable fitness bench of claim 1, wherein the handle comprises a plurality of finger wells therein.

* * * * *